US005671484A

United States Patent [19]

Lee, III

[11] Patent Number: 5,671,484

[45] Date of Patent: Sep. 30, 1997

[54] TOILET VENTILATOR APPARATUS

[76] Inventor: Robert Lee, III, P.O. Box 477, Clayton, La. 71326

[21] Appl. No.: 685,989

[22] Filed: Jul. 22, 1996

[51] Int. Cl.[6] ..... E03D 9/04

[52] U.S. Cl. ..... 4/213; 4/217; 4/209 R; 4/218

[58] Field of Search ..... 4/213, 217, 218, 4/200 R

[56] References Cited

U.S. PATENT DOCUMENTS

| | | | |
|---|---|---|---|
| 3,491,382 | 1/1970 | Poister | 4/213 |
| 3,585,651 | 6/1971 | Cox | 4/213 |
| 4,200,940 | 5/1980 | Buchanan | 4/213 |
| 5,179,737 | 1/1993 | Ricard | 4/213 |
| 5,452,481 | 9/1995 | Meyer | 4/213 |
| 5,454,122 | 10/1995 | Bergeron | 4/213 |

*Primary Examiner*—David J. Walczak

[57] ABSTRACT

A toilet ventilator apparatus including a toilet seat with an odor collection channel formed therein. Such channel terminates at an evacuation nozzle. Also included is at least one odor collection vent which is adapted for receiving unpleasant odors from the air within the vicinity of a toilet bowl. A vacuum is coupled to the evacuation nozzle of the toilet seat for transferring unpleasant odors contained within the air in the vicinity of a toilet bowl through the toilet seat to a location remote from the toilet bowl via a fan when energized. Further provided is a scenting mechanism for masking the unpleasant odors contained in the evacuated air. The scenting mechanism has an associated conduit with an outlet thereof situated adjacent the fan of the vacuum and a scent switch for allowing the air containing odor to be scented upon the depression thereof.

8 Claims, 5 Drawing Sheets

FIG. 1
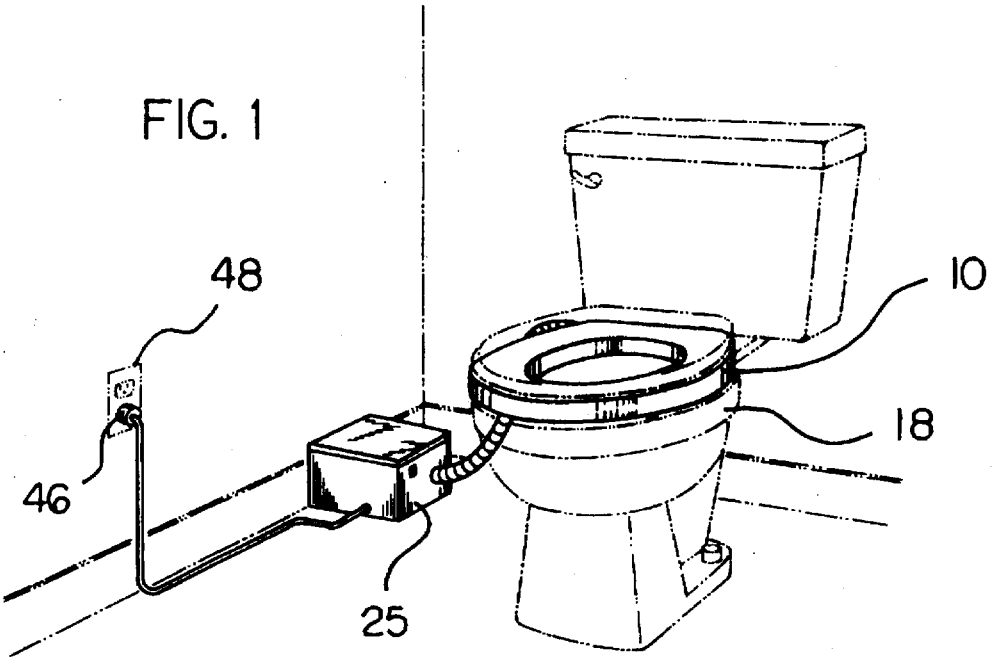
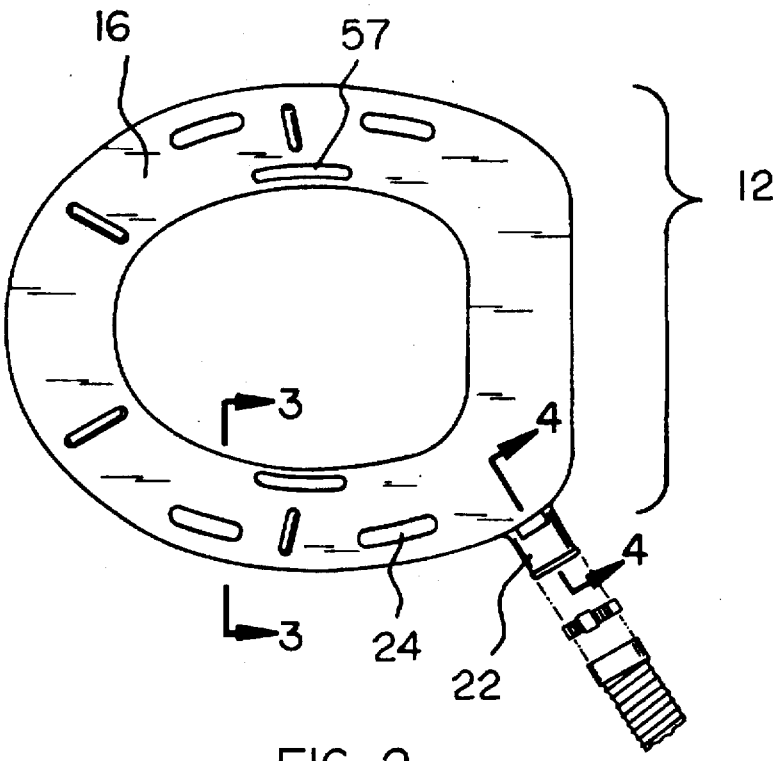
FIG. 2

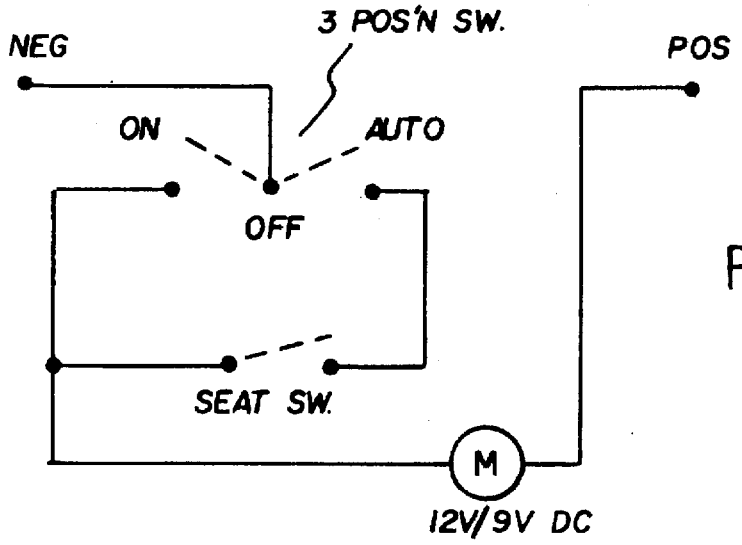
FIG 9
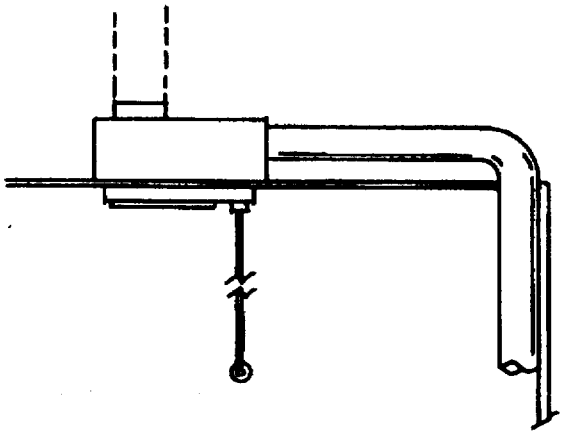
FIG 10
FIG 11
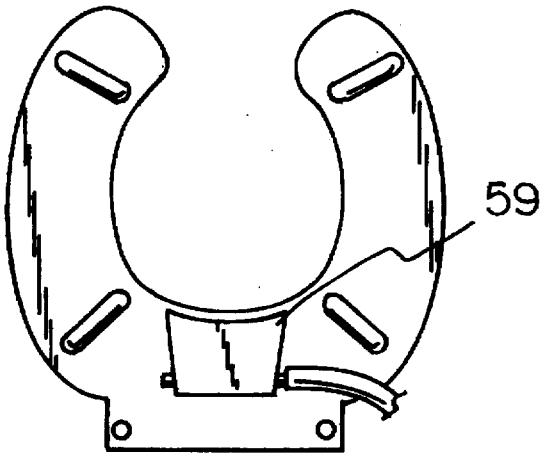

TOILET VENTILATOR APPARATUS

BACKGROUND OF THE INVENTION

1. Field of the Invention

The present invention relates to a toilet ventilator apparatus and more particularly pertains to drawing air containing odor away from an associated toilet bowl and further selectively scenting the air with a toilet ventilator apparatus capable of being activated by various methods.

2. Description of the Prior Art

The use of toilet odor removal systems is known in the prior art. More specifically, toilet odor removal systems heretofore devised and utilized for the purpose of removing odors from an area surrounding a toilet are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 326,510 to Gusta, Jr. discloses a ventilator system for a toilet.

U.S. Pat. No. 4,251,888 to Turner discloses a ventilating toilet seat.

U.S. Pat. No. 4,993,083 to Lemieux discloses a ventilated toilet.

U.S. Pat. No. 5,044,018 to Gandini discloses a toilet with device for removing unpleasant odors.

U.S. Pat. No. 5,170,512 to Prisco discloses a toilet odor removal system.

In this respect, the toilet ventilator apparatus according to the present invention substantially departs from the conventional concepts and designs of the prior art, and in so doing provides an apparatus primarily developed for the purpose of drawing air containing odor away from an associated toilet bowl and further selectively scenting the air with a toilet ventilator apparatus capable of being activated by various methods.

Therefore, it can be appreciated that there exists a continuing need for a new and improved toilet ventilator apparatus which can be used for drawing air containing odor away from an associated toilet bowl and further selectively scenting the air with a toilet ventilator apparatus capable of being activated by various methods. In this regard, the present invention substantially fulfills this need.

SUMMARY OF THE INVENTION

In the view of the foregoing disadvantages inherent in the known types of toilet odor removal systems now present in the prior art, the present invention provides an improved toilet ventilator apparatus. As such, the general purpose of the present invention, which will be described subsequently in greater detail, is to provide a new and improved toilet ventilator apparatus and method which has all the advantages of the prior art and none of the disadvantages.

To attain this, the present invention essentially comprises, in combination, a toilet seat having a top surface, a bottom surface adapted to rest on a lip of a toilet bowl, an odor collection channel formed therein and terminated at an evacuation nozzle, and a plurality of oblong odor collection vents disposed on the bottom surface and in communication with the odor collection channel for receiving unpleasant odors contained in the air within the vicinity of a toilet bowl, the vents positioned adjacent an outer periphery of the toilet seat for preventing inadvertent splashes therein with the vents formed above the lip of the toilet bowl ¾ of an inch from the outer periphery of the toilet seat, wherein the vents are constructed to be ½ of an inch in width and positioned on opposite sides of the toilet seat; and a vacuum further comprising: a hollow, rigid, and generally box-shaped housing situated on a floor adjacent the toilet bowl, the housing having an inlet and an outlet extended therefrom, the outlet having a screen disposed thereover with the air being evacuated at a location adjacent to the housing, wherein the screen is adapted to prevent dust and debris from entering the housing; a motor disposed within the housing with the motor having a fixed stator coupled to the housing and a rotatable rotor positioned in a general axial alignment with the inlet and outlet of the housing; a fan coupled to the rotor and with the fan adapted to transfer air with unpleasant odors therein through the housing from the inlet to the outlet, the fan having a plurality of blades formed of essentially flat imperforate members rotatable in a plane of rotation with the blades being angled and offset from the plane of rotation; a power cable having a first end adapted to receive power from an external power source and a second end extended through the housing for delivering power to the motor for rotating the rotor; a pressure switch coupled on a hinge between the toilet seat and the toilet bowl with the pressure switch situated on a lower surface of an essentially stationary inboard portion of the hinge, wherein the coupling of the inboard portion of the hinge to the toilet bowl is performed with a bolt, a complimentary washer, nut, and a spring situated between the bolt and washer, whereby the pressure switch has one orientation where the inboard portion is lowered and the spring is biased for allowing the vacuum to be energize when pressure is applied to the toilet seat and another orientation when pressure is removed from the toilet seat with the inboard portion raised and the spring unbiased for preventing the vacuum from being energized; circuitry for allowing the present invention to be actuated solely via the pressure switch, manually via a three-terminal switch, or not actuated Under any circumstance, wherein the three-terminal switch has a first terminal thereof electrically connected to the second end of the power cable, a second terminal electrically connected to a first terminal of the motor with a second terminal of the motor being connected to the second end of the power cable, and a third terminal coupled to a first terminal of the pressure switch, a second terminal of the pressure switch coupled to the first terminal of the motor, whereby the three-terminal switch has a first orientation wherein the first terminal thereof contacts the second terminal thereof for manual actuation of the motor, a second orientation wherein the first terminal thereof contacts the third terminal thereof for actuation of the motor via solely the pressure switch, and a third orientation wherein the first terminal is open for precluding actuation of the motor; a flexible evacuation hose coupled between the evacuation nozzle on the toilet seat and the inlet of the housing; a replaceable charcoal filter disposed within the housing for removing unpleasant odors from the evacuated air; and scenting means for masking the unpleasant odors contained in the evacuated air, the scenting means adapted to receive power from the second end of the power cable, the scenting means located within the housing and having an associated conduit with an outlet thereof situated adjacent the fan near the outlet of the housing, and a scent switch situated on a top portion of the housing for allowing the dispersion of scented air from the outlet upon the depression thereof; whereby when the vacuum is energized, unpleasant odors contained within the air in the vicinity of a toilet bowl are evacuated through the toilet seat and through the vacuum to be filtered, optionally scented, and then deposited at a location remote from the toilet bowl.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved toilet ventilator apparatus which has all the advantages of the prior art toilet odor removal systems and none of the disadvantages.

It is another object of the present invention to provide a new and improved toilet ventilator apparatus which may be easily and efficiently manufactured and marketed.

It is a further object of the present invention to provide a new and improved toilet ventilator apparatus which is of a durable and reliable construction.

An even further object of the present invention is to provide a new and improved toilet ventilator apparatus which is susceptible of a low cost of manufacture with regard to both materials and labor, and which accordingly is then susceptible of low prices of sale to the consuming public, thereby making such toilet ventilator apparatus economically available to the buying public.

Still yet another object of the present invention is to provide a new and improved toilet ventilator apparatus which provides in the apparatuses and methods of the prior art some of the advantages thereof, while simultaneously overcoming some of the disadvantages normally associated therewith.

Yet another object of the present invention is to provide a toilet ventilator apparatus with associated vents designed and situated to prevent water entry resulting from splashing.

Another object of the present invention is to provide a toilet ventilator apparatus with a pressure activated switch designed and situated to prevent inadvertent actuation and further remain concealed.

Still yet another object of the present invention is to provide a toilet ventilator apparatus with circuitry designed to allow the present invention to be selectively actuated by various methods.

Still another object of the present invention is to draw air containing odor away from an associated toilet bowl and further to selectively scent the air.

Lastly, it is an object of the present invention to provide a new and improved toilet ventilator apparatus including a toilet seat with an odor collection channel formed therein. Such channel terminates at an evacuation nozzle. Also included is at least one odor collection vent which is adapted for receiving unpleasant odors from the air within the vicinity of a toilet bowl. A vacuum is coupled to the evacuation nozzle of the toilet seat for transferring unpleasant odors contained within the air in the vicinity of a toilet bowl through the toilet seat to a location remote from the toilet bowl via a fan when energized. Further provided is a scenting mechanism for masking the unpleasant odors contained in the evacuated air. The scenting mechanism has an associated conduit with an outlet thereof situated adjacent the fan of the vacuum and a scent switch for allowing the air to be scented upon the depression thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment constructed in accordance with the principles of the present invention in operation on a toilet.

FIG. 2 is a plan view of the bottom surface of the toilet seat and the coupling of the toilet seat with the evacuation hose.

FIG. 9 is a schematic of the circuitry employed in one of the alternate embodiments of the present invention.

FIG. 10 is a side plan view of the pull cord associated with one of the alternate embodiments of the present invention.

FIG. 11 is a bottom plan view of a vent which may be retrofitted to a conventional toilet seat as set forth in the present invention.

Similar reference characters refer to similar parts throughout the several views of the drawings.

DESCRIPTION OF THE PREFERRED EMBODIMENT

Figure 3:
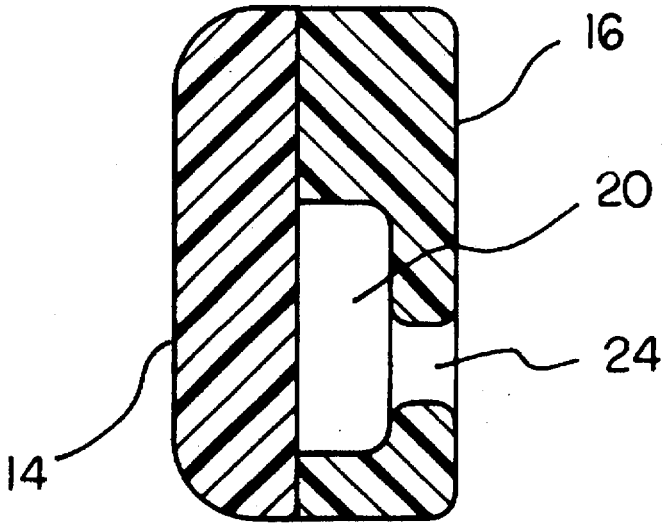
FIG. 3 is a cross-sectional view of the toilet seat taken along the line 3—3 of FIG. 2.
Figure 4:
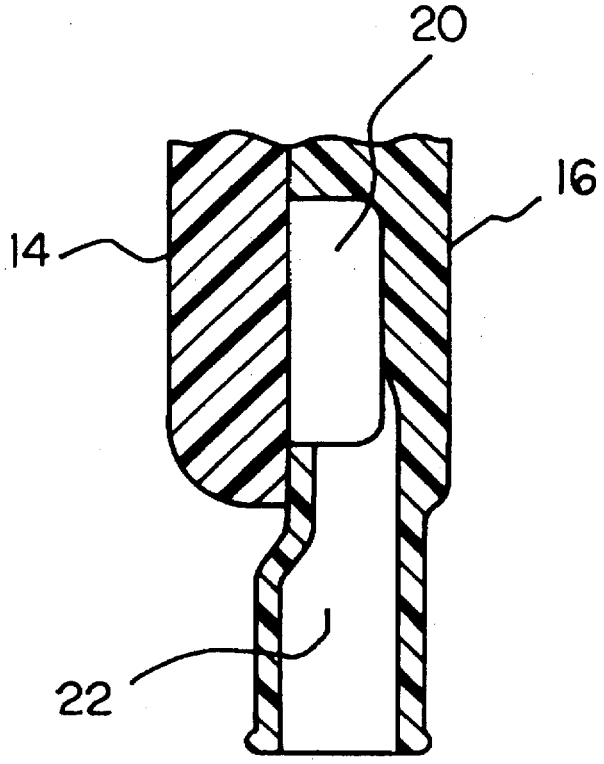
FIG. 4 is a cross-sectional view of the nozzle of the toilet seat taken along the line 4—4 of FIG. 2.
Figure 5:
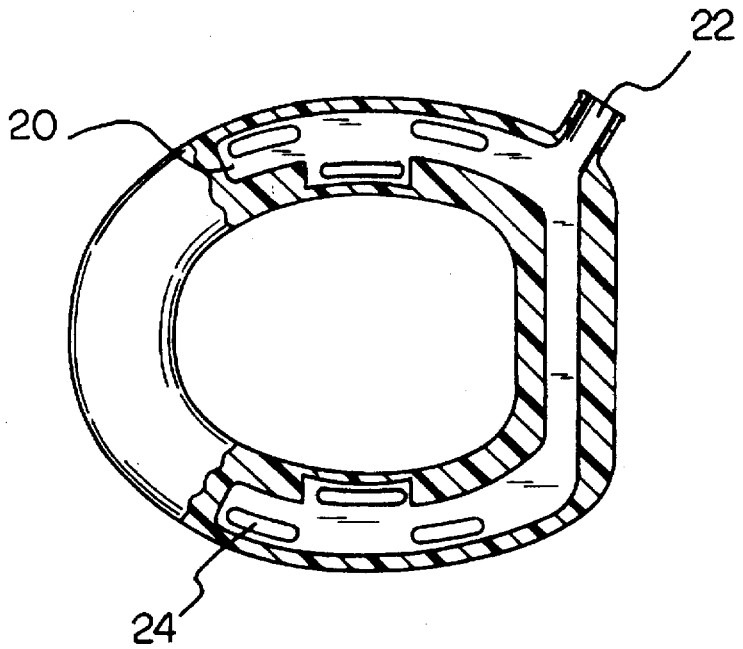
FIG. 5 is a cross-sectional view through the top surface of the toilet seat depicting the relative position of the odor collection vents in relation to the odor collection channel.
Figure 6:
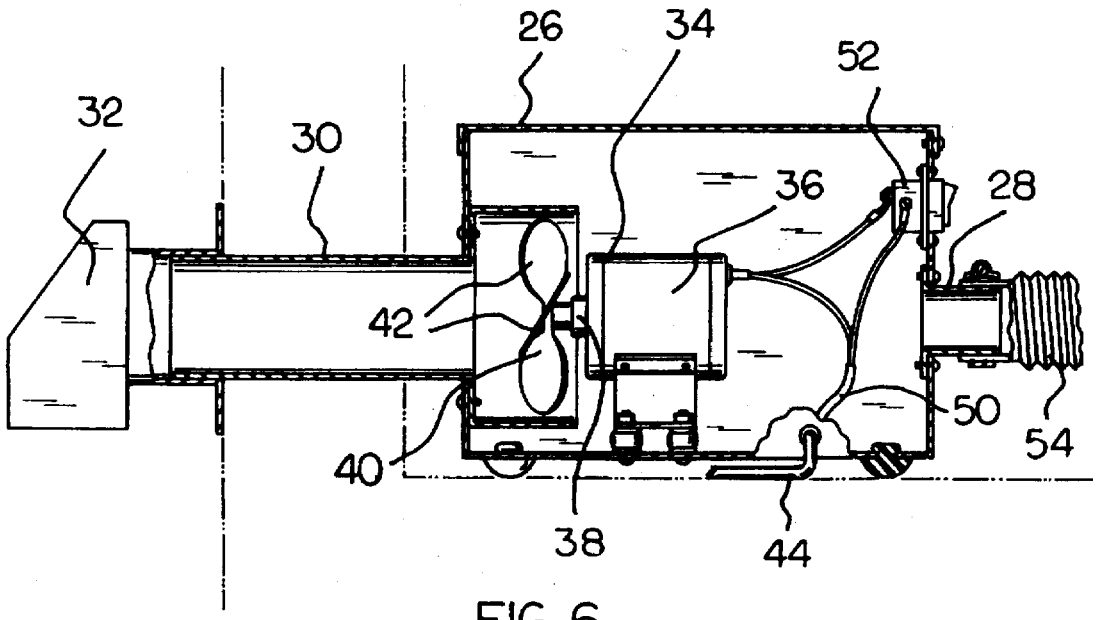
FIG. 6 is a cross-sectional view of the vacuum of the present invention with the inlet thereof connected to the evacuation hose and the outlet thereof connected to a remote location for removing unpleasant odors.

With reference now to the drawings, and in particular, to FIG. 1 thereof, the preferred embodiment of the new and improved toilet ventilator apparatus embodying the principles and concepts of the present invention and generally designated by the reference number 10 will be described.

Specifically, the present invention includes two major components. The major components are the toilet seat and the vacuum. These components are interrelated to provide the intended function.

More specifically, it will be noted in the various Figures that the first major component is toilet seat 12. The toilet seat is rigid in structure and is sized to fit upon a conventional toilet bowl. The toilet seat has a top surface 14 and a bottom surface 16 adapted to rest upon the lip of a toilet bowl 18. The toilet seat has an odor collection channel 20 formed therein. The odor collection channel is terminated at an evacuation nozzle and at a plurality of odor collection vents 24 disposed on the bottom surface. The odor collection vents are adapted for receiving unpleasant odors from within the vicinity of a toilet bowl. The toilet seat may be fabricated from a variety of materials and may be formed in a variety of colors to match the decor of a rest room or bathroom.

The second major component is the vacuum 25. The vacuum includes six subcomponents. The subcomponents are the housing, motor, fan, power cable, activation switch and evacuation hose. These subcomponents are interrelated to provide the intended function.

The first subcomponent of the vacuum is the housing 26. The housing is hollow, rigid, and generally box-shaped in structure. It has an inlet 28 formed thereon and extended from one side. It has an outlet 30 extended therefrom on the opposite side from the inlet. Both the inlet and the outlet are aligned about a common axis of symmetry. The outlet is adapted to have a length such that it may be extended through a wall to a location remote from the position of the housing. A vent cover 32 is coupled to the outlet for preventing dust and other debris from entering the interior of the housing.

The second subcomponent of the vacuum is the motor 34. The motor is disposed within the housing 26. The motor has a fixed stator 36 coupled to the housing. The motor also has a rotatable rotor 38 extended from the stator and positioned in a general axial alignment with the inlet 28 and outlet 30 of the housing. The motor is conventional in design and commercially available. Motors commonly used in household vacuum cleaners may be utilized.

The third subcomponent of the vacuum is the fan 40. The fan is coupled to the rotor. The fan is adapted to transfer air containing unpleasant odors through the housing 26 from the inlet 28 to the outlet 30. The fan includes a plurality of blades 42 extended outwards from the rotor and formed of essentially flat imperforate members. These imperforate members are rotatable in a plane of rotation essentially perpendicular to the axial alignment of the rotor, inlet, and outlet of the housing. The blades are angled and offset from the plane of rotation to maximize their combined evacuation force.

The fourth subcomponent of the vacuum is the power cable 44. The power cable has a first end 46 adapted to receive power from an external power source. A commercial power source employing 110 volt alternating current distributed through a common household socket 48 is preferred for use. The second end 50 of the power cable is extended through the housing 26 for delivering power to the motor 34 for rotating the rotor. Accordingly, the power cable is constructed with materials adapted to carry the load of power from the source to the motor.

The fifth subcomponent of the vacuum is the activation switch 52. The activation switch is disposed on the housing 26. It is electrically connected between the second end of the power cable 50 and the stator 36 of the motor. The activation switch has one orientation for energizing the motor. The activation switch also has another orientation for de-energizing the motor. Optionally, the vacuum is positioned on a ceiling adjacent the toilet seat, as shown in FIG. 10. In such a position, the air containing odor may be conveniently expelled from a roof of a building. Ideally, the activation switch comprises a pull cord coupled to and depending from the vacuum. In use, the motor of the vacuum is energized upon the pull cord being pulled a first time. The motor of the vacuum may be subsequently de-energized upon pulling the pull cord a second time.

The sixth subcomponent of the vacuum is the evacuation hose 54. The evacuation hose is elongated and flexible. It has a plurality of bellows formed thereon for preventing the hose from becoming kinked or damaged. The evacuation hose has one end coupled to the evacuated nozzle 22 on the toilet seat. The other end of the evacuation hose is coupled to the inlet 28 of the vacuum. The coupling is performed on both ends with hose clamps 56.

When the vacuum is energized, unpleasant odors contained within the air in the vicinity of a toilet bowl enter the odor collection vents 24 and are evacuated through the toilet seat and through the vacuum. The odors are then deposited at a location remote from the toilet bowl. The remote location could be one that is positioned in an area entirely offset from the vacuum or an area positioned at a distance from and downwind from the toilet bowl.

In the preferred embodiment of the present invention, the odor collection vents are positioned adjacent an outer periphery of the toilet seat for preventing any inadvertent splashes therein. Ideally, the vents are formed above the lip of the toilet bowl and further ¾ of an inch from the outer periphery of the toilet seat. The vents are constructed to be ½ of an inch in width and positioned on opposite sides of the toilet seat. The vents are angled to draw air across the toilet bowl. Optionally, additional vents 57, as shown in FIG. 2, may be formed adjacent an inner circumference of the toilet seat if inadvertent splashes are not of a concern to further aid in drawing air across the toilet bowl. Such additional vents 57 have a similar shape and form as vents 24. As a further option, a vent 59 may be retrofitted to a lower portion of the toilet seat at a rear extent thereof. The retrofittable vent comprises a generally rectangular housing with an arcuate opening positioned adjacent an inner circumference of the toilet seat. Note FIG. 11.

The vacuum is mounted or placed at a location near or below the toilet seat. The present invention can be adapted to be utilized under 12 volt DC power or 115 volt AC power stepped down to a safe level. With such versatility the present invention may be employed in RV's, mobile homes, and the like. To further insure the safety of the user, the present invention ensures that no dangerous levels of voltage reside on the toilet bowl.

Figure 7:
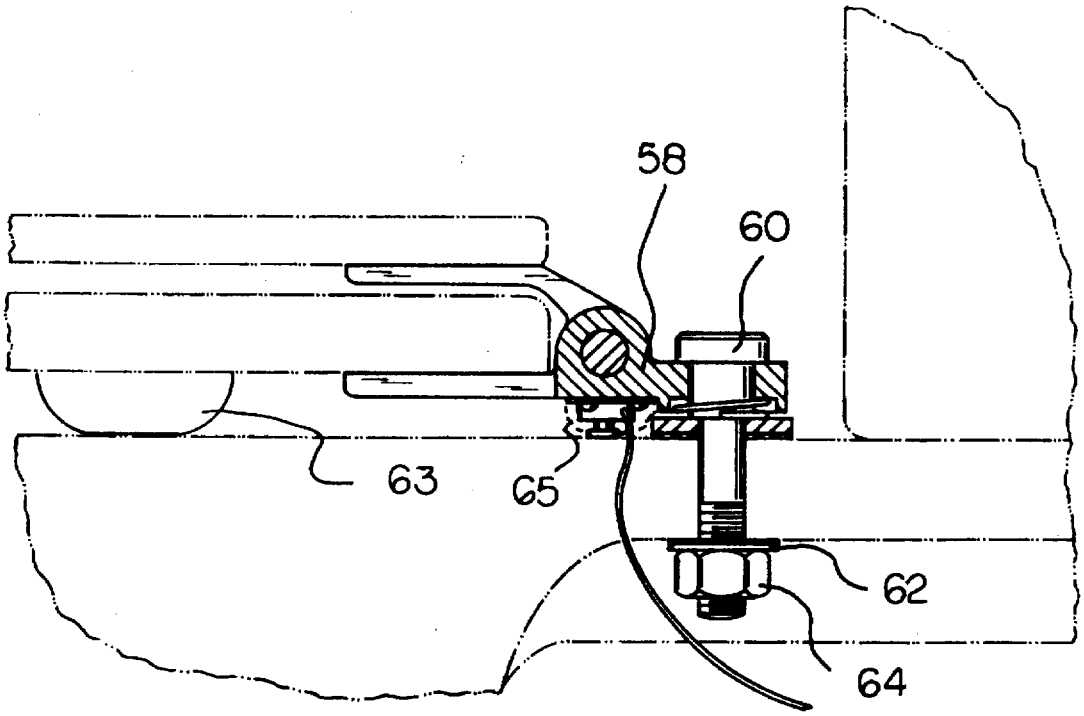
FIG. 7 is a cross/sectional view of an alternate embodiment of the present invention depicting a pressure switch coupled to the seat for energizing the vacuum when pressure is applied to the seat and de-energizing the vacuum when pressure is removed from the seat.

A second embodiment of the present invention is shown in FIG. 7. This embodiment includes substantially all of the components of the present invention further including a pressure switch 58. The pressure switch is coupled between the toilet seat 12 and the toilet bowl 18 on an unnumbered hinge coupled therebetween. Preferably, the pressure switch is situated on a lower surface of an essentially stationary inboard portion of the hinge. The coupling of the inboard portion of the hinge to the toilet bowl is performed with a bolt 60, a complimentary washer 62, nut 64, and an unnumbered spring situated between the bolt and washer. In use, the pressure switch remains out of view and reach between the inboard portion of the hinge and the toilet bowl despite the pivoting of the toilet seat with respect to the toilet bowl. As such, the position of the pressure switch ensures that the switch is not manipulated inadvertently and further contributes to the aesthetic nature of the present invention. When pressure is applied to the toilet seat, the pressure switch has one orientation where the inboard portion is lowered and the spring is biased for allowing the vacuum to be energized. The pressure switch has another orientation when pressure is removed from the toilet seat wherein the inboard portion is raised and the spring is unbiased for preventing the vacuum from being energized. To ensure that the pressure switch may be depressed when a user sits upon the toilet seat, resilient sightly deformable pads 63 are situated on a bottom surface of the toilet seat. The pressure switch is preferably covered with a flexible elastomeric bulb 65 so as to prevent contact with urine which would effect corrosion. Also, it should be noted that electrical connection between the pressure switch and the motor is afforded via a wire which resides ideally within the evacuation hose 54.

To allow a user to select one of various methods of actuation, a circuit is optionally included. Such circuit allows the present invention to be actuated solely via the pressure switch 58, manually via a three-terminal switch, or not actuated under any circumstance. To accomplish such, as shown in FIG. 9, the three-terminal switch is included with a first terminal thereof electrically connected to a negative terminal of the power source, a second terminal electrically connected to a first terminal of the motor, and a third terminal coupled to a first terminal of the pressure switch. A second terminal of the pressure switch is coupled to the first terminal of the motor. As shown in the schematic, a second terminal of the motor is connected to a positive terminal of the power source via the second end of the power cable. In use, a user may position the three-terminal switch in a first orientation wherein the first terminal thereof contacts the second terminal thereof for manual actuation of the motor. The user may also position the three-terminal switch in a second orientation wherein the first terminal thereof contacts the third terminal thereof for actuation of the motor via solely the pressure switch. Finally, for preventing the actuation of the present invention under any circumstance, the first terminal may be electrically connected with neither of the remaining terminals in a third orientation.

Figure 8:
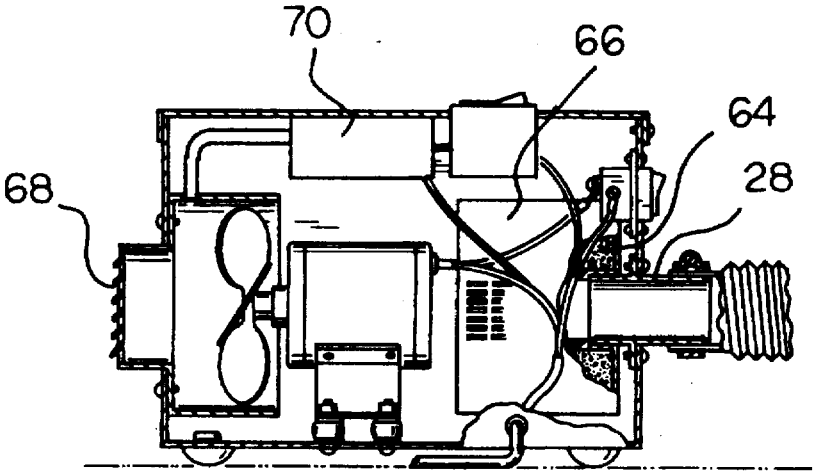
FIG. 8 is a cross-sectional view of yet another alternate embodiment of the present invention depicting a replaceable charcoal filter disposed within the housing and around the inlet of the vacuum and further a scenting mechanism for removing unpleasant odors evacuated from the toilet bowl.

A third embodiment of the present invention is shown in FIG. 8. This embodiment includes substantially all of the components of the present invention further including a filter 64. The filter is disposed within a vented filter container 66. Both the vented filter container and the filter are positioned adjacent to the inlet 28 of the housing. The filter consists of a replaceable charcoal insert. The filter is adapted for removing unpleasant odors from the air evacuated from the toilet bowl. Since the air from the from the toilet bowl has now been filtered with the charcoal insert, the outlet 30 of the housing does not have to be extended to a remote location. In this case, a screen 68 is disposed over the outlet with the air being evacuated at a location adjacent to the housing. The screen is adapted to prevent dust and debris from entering the housing.

A fourth embodiment of the present invention includes substantially all of the components of the present invention further including a scenting mechanism 70 for masking the unpleasant odors contained in the evacuated air. This scenting mechanism may be replaced when it loses its effectiveness. Ideally, the scenting mechanism is located within the housing and has an associated conduit with an outlet thereof situated adjacent the fan near the outlet of the housing. The scenting mechanism receives power from the second end of the power cable. A scent switch is situated on a top portion of the housing for allowing the dispersion of scented air from the outlet upon the depression thereof. As such, the fan further deploys the scented air. The second and third embodiments of the present invention can also be outfitted with this scenting mechanism.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toilet ventilator apparatus for evacuating unpleasant odors from a toilet to an area adjacent thereto comprising, in combination:

a toilet seat having a top surface, a bottom surface adapted to rest on a lip of a toilet bowl, an odor collection channel formed therein and terminated at an evacuation nozzle, and a plurality of oblong odor collection vents disposed on the bottom surface and in communication with the odor collection channel for receiving unpleasant odors contained in the air within the vicinity of a toilet bowl, the vents positioned adjacent an outer periphery of the toilet seat for preventing inadvertent splashes therein with the vents formed above the lip of the toilet bowl ¾ of an inch from the outer periphery of the toilet seat, wherein the vents are constructed to be ½ of an inch in width and positioned on opposite sides of the toilet seat; and a vacuum further comprising:

a hollow, rigid, and generally box-shaped housing situated on a floor adjacent the toilet bowl, the housing having an inlet and an outlet extended therefrom, the outlet having a screen disposed thereover with the air being evacuated at a location adjacent to the housing, wherein the screen is adapted to prevent dust and debris from entering the housing;

a motor disposed within the housing with the motor having a fixed stator coupled to the housing and a rotatable rotor positioned in a general axial alignment with the inlet and outlet of the housing;

a fan coupled to the rotor and with the fan adapted to transfer air with unpleasant odors therein through the housing from the inlet to the outlet, the fan having a plurality of blades formed of essentially flat imperforate members rotatable in a plane of rotation with the blades being angled and offset from the plane of rotation;

a power cable having a first end adapted to receive power from an external power source and a second end extended through the housing for delivering power to the motor for rotating the rotor;

a pressure switch coupled on a hinge between the toilet seat and the toilet bowl with the pressure switch situated on a lower surface of an essentially stationary inboard portion of the hinge, wherein the coupling of the inboard portion of the hinge to the toilet bowl is performed with a bolt, a complimentary washer, nut, and a spring situated between the bolt and washer, whereby the pressure switch has one orientation where the inboard portion is lowered and the spring is biased for allowing the vacuum to be energize when pressure is applied to the toilet seat and another orientation when pressure is removed from the toilet seat with the inboard portion raised and the spring unbiased for preventing the vacuum from being energized;

circuitry for allowing the present invention to be actuated solely via-the pressure switch, manually via a three-terminal switch, or not actuated under any circumstance, wherein the three-terminal switch has a first terminal thereof electrically connected to the second end of the power cable, a second terminal electrically connected to a first terminal of the motor with a second terminal of the motor being connected to the second end of the power cable, and a third terminal coupled to a first terminal of the pressure switch, a second terminal of the pressure switch coupled to the first terminal of the motor, whereby the three-terminal switch has a first orientation wherein the first terminal thereof contacts the second terminal thereof for manual actuation of the motor, a second orientation wherein the first terminal thereof contacts the third terminal thereof for actuation of the motor via solely the pressure switch, and a third orientation wherein the first terminal is open for precluding actuation of the motor;

a flexible evacuation hose coupled between the evacuation nozzle on the toilet seat and the inlet of the housing;

a replaceable charcoal filter disposed within the housing for removing unpleasant odors from the evacuated air; and scenting means for masking the unpleasant odors contained in the evacuated air, the scenting means adapted to receive power from the second end of the power cable, the scenting means located within the housing and having an associated conduit with an outlet thereof situated adjacent the fan near the outlet of the housing, and a scent switch situated on a top portion of the housing for allowing the dispersion of scented air from the outlet upon the depression thereof;

whereby when the vacuum is energized, unpleasant odors contained within the air in the vicinity of a toilet bowl are evacuated through the toilet seat and through the vacuum to be filtered, optionally scented, and then deposited at a location remote from the toilet bowl.

2. A toilet ventilator apparatus comprising:

a housing;

a toilet seat having an odor collection channel which terminates at an evacuation nozzle and at least one odor collection vent adapted for receiving unpleasant odors from the air within the vicinity of a toilet bowl;

vacuuming means coupled to the evacuation nozzle of the toilet seat for transferring unpleasant odors contained within the air in the vicinity of a toilet bowl through the toilet seat to a location remote from the toilet bowl via a fan when energized;

scenting means for masking the unpleasant odors contained in the evacuated air, the scenting means located within the housing and having an associated conduit with an outlet thereof situated adjacent the fan of the vacuuming means, and a scent switch for allowing the dispersion of scented air from the outlet of the scenting means upon the depression thereof;

a pressure switch coupled to the seat with the pressure switch having one orientation for allowing the vacuuming means to be energized when pressure is applied to the toilet seat and another orientation for preventing the vacuuming means from being energized when pressure is removed from the toilet seat; and circuitry for allows the present invention to be actuated solely via the pressure switch, manually via a three-terminal switch, or not actuated under any circumstance, wherein the three-terminal switch has a first terminal thereof electrically connected to a power source, a second terminal electrically connected to a first terminal of the vacuuming means with a second end of the vacuuming means being connected to the power means, and a third terminal coupled to a first terminal of the pressure switch, a second terminal of the pressure switch coupled to the first terminal of the vacuuming means, whereby the three-terminal switch has a first orientation wherein the first terminal thereof contacts the second terminal for manual actuation of the vacuuming means, a second orientation wherein the first terminal thereof contacts the third terminal for actuation of the vacuuming means via solely the pressure switch, and a third orientation wherein the first terminal is open for precluding actuation of the vacuuming means.

3. The toilet ventilator apparatus as set forth in claim 2 further including a replaceable charcoal filter disposed within the vacuum for removing unpleasant odors from the air evacuated from the toilet bowl to produce filtered air.

4. The toilet ventilator apparatus as set forth in claim 2 wherein the vacuuming means is positioned on a ceiling adjacent the toilet seat and further includes an activation switch for energizing the vacuuming means, the activation switch including a pull cord coupled to and depending from the vacuuming means wherein the vacuuming means is energized upon the pull cord being pulled a first time and the vacuum is de-energized upon pulling the pull cord a second time.

5. The toilet ventilator apparatus as set forth in claim 2 wherein the vents are positioned adjacent an outer periphery of the toilet seat for preventing inadvertent splashes therein with the vents formed above a lip of the toilet bowl ¾ of an inch from the outer periphery of the toilet seat, wherein the vents are constructed to be ½ of an inch in width and positioned on opposite sides of the toilet seat.

6. The toilet ventilator apparatus as set forth in claim 5 and further including additional vents formed adjacent an inner periphery of the toilet seat.

7. The toilet ventilator apparatus as set forth in claim 2 wherein said pressure switch is coupled on a hinge between the toilet seat and a toilet bowl with the pressure switch situated on a lower surface of an essentially stationary inboard portion of the hinge, wherein the coupling of the inboard portion of the hinge to the toilet bowl is performed with a bolt, a complimentary washer, nut, and a spring situated between the bolt and washer, whereby the pressure switch has one orientation where the inboard portion is lowered and the spring is biased for allowing the vacuum to be energized when pressure is applied to the toilet seat and another orientation when pressure is removed from the toilet seat with the inboard portion raised and the spring unbiased for preventing the vacuum from being energized.

8. A toilet ventilator apparatus comprising:

a toilet seat having an odor collection channel formed therein and terminated at an evacuation nozzle and at least one odor collection vent adapted for receiving unpleasant odors from the air within the vicinity of a toilet bowl;

vacuuming means coupled to the evacuation nozzle of the toilet seat for transferring unpleasant odors contained within the air in the vicinity of a toilet bowl through the toilet seat to a location remote from the toilet bowl via a fan when energized;

a pressure switch coupled between the toilet seat and a toilet bowl on a hinge coupled therebetween with the pressure switch situated on a lower surface of an essentially stationary inboard portion of the hinge with an elastomeric bulb covered over said switch, wherein the coupling of the inboard portion of the hinge to the toilet bowl is performed with a bolt, a complimentary washer, nut, and a spring situated between the bolt and washer, whereby the pressure switch has one orientation where the inboard portion is lowered and the spring is biased for allowing the vacuuming means to be energized when pressure is applied to the toilet seat and another orientation when pressure is removed from the toilet seat with the inboard portion raised and the spring unbiased for preventing the vacuuming means from being energized; and resilient slightly deformable pads situated on a bottom surface of the toilet seat.

* * * * *